United States Patent [19]

Tokukatsu

[11] Patent Number: 4,664,007

[45] Date of Patent: May 12, 1987

[54] HOOP MATERIAL CUTTER

[76] Inventor: Seiji Tokukatsu, 37-9, 4-Chome, Nishiarai, Adachi-ku, Tokyo, Japan

[21] Appl. No.: 456,738

[22] Filed: Jan. 10, 1983

[51] Int. Cl.[4] ..... B26D 5/00

[52] U.S. Cl. ..... 83/373; 83/628; 83/646; 83/923; 83/602

[58] Field of Search ..... 83/923, 602, 196, 441, 83/609, 646, 597, 598, 601, 627, 628, 635, 827, 373; 277/30, 95, 237 R

[56] References Cited

U.S. PATENT DOCUMENTS 3,376,773 4/1968 La Motte ..... 83/373

FOREIGN PATENT DOCUMENTS 18277 2/1977 Japan ..... 83/577
18278 2/1977 Japan ..... 83/577
2065502 7/1981 United Kingdom .

*Primary Examiner*—Donald R. Schran
*Assistant Examiner*—James L. Wolfe
*Attorney, Agent, or Firm*—Bruce L. Adams; Robert E. Burns; Emmanuel J. Lobato

[57] ABSTRACT

In a hoop material cutter having a movable blade driven by an eccentric cam to effect swirl or rocking motion of the movable blade, the hoop material is fed in a direction opposite to the moving direction of the movable blade. The space between the movable blade and the housing is enclosed, and the feeding hopper for feeding the hoop material is mounted to undergo movement with the movable blade.

6 Claims, 6 Drawing Figures

HOOP MATERIAL CUTTER

BACKGROUND OF THE INVENTION

The present invention relates to a hoop material cutter, and more specifically to a hoop material cutter for cutting scrap hoop material which is fed from a press unit and comprises a generally box-like frame having a fixed blade at one end, means to feed hoop material into the frame, a movable ram having at one end a movable blade and being movably inserted in the frame, a drive means mounted on the frame and having a rotatable eccentric cam, means connecting the other end of the ram and the eccentric cam to swirl the ram, and guide means at said one end of the ram.

Such hoop material cutter is described in our British patent application GB No. 2065502A. As the ram and the movable blade swirl and rock relative to the fixed blade during the cutting operation, the hoop material is cut from one edge by sequential point contact between the movable blade and the fixed blade, so that very efficient and smooth cutting is performed.

However, the hoop material cutter described in the aforesaid British patent application cuts the hoop material by moving the movable blade in the same direction relative to the feeding direction of the hoop material. Thus, the movable blade tends to pull the hoop material while cutting. This may cause an adverse effect to the alignment between the hoop and the press dies, especially when printed material is to be pressed.

Further, as the ram moves back and forth in the open end of the frame, debris or small pieces of cut material tend to be introduced into the ram moving space to cause an adverse effect to the operation of the ram.

SUMMARY OF THE INVENTION

The object of the present invention is to eliminate the above mentioned disadvantages.

To attain the above mentioned object, the hoop material cutter of the type described provides packing means between both side edges of the ram and adjacent surfaces of the frame, and means to apply the cutting force substantially opposite to the hoop material feeding direction.

As the movable blade tends to push back the hoop material during the cutting operation, the pushing force is easily absorbed by slight bending of the hoop material and no adverse effect is caused to the press operation.

Preferably, means to feed hoop material in the frame comprises a hopper secured with the ram.

As the end of the hoop material always rests on the fixed blade, hoop material is fed smoothly as soon as the movable blade is separated from the fixed blade.

As both side clearances between the ram and the inner walls of the frame are sealed by packing means, smooth operation of the ram in the frame is assured.

BRIEF DESCRIPTION OF THE DRAWINGS

A preferred embodiment of the present invention, by way of example, will be described in detail referring to the drawings, in which.

DETAILED DESCRIPTION OF PREFERRED EMBODIMENT

Figure 1:
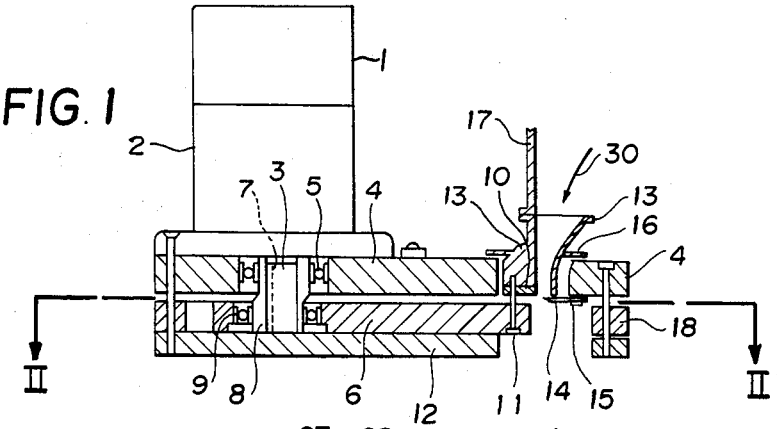
FIG. 1 is a longitudinal sectional view of a hoop material cutter, according to the present invention.
Figure 2:
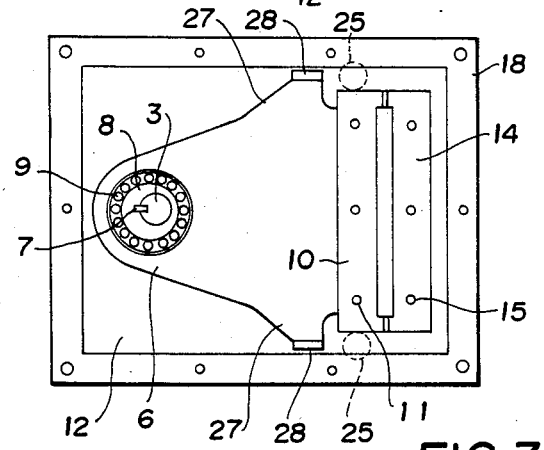
FIG. 2 is a sectional view along line II—II of FIG. 1.

Referring to FIGS. 1 and 2, a hoop material cutter according to a preferred embodiment of the invention includes a motor 1 with a reduction unit 2 secured with an upper base plate 4. A drive shaft 3 is rotatably supported through a bearing 5 by the base plate 4 and projects downwards through the base plate 4.

An eccentric cam 8 is secured through a key 7 with the drive shaft 3. One end portion of a sector-shaped ram 6 is supported by the eccentric cam 8 through a bearing 9. The ram is slidable on a lower base plate 12. A movable blade 10 of the cutter is exchangeably mounted by bolts 11 with the other end of the ram. The lower base plate 12 is secured with the upper base plate 4 through side wall means 18 which encloses the ram 6 and forms between the upper and lower base plates 4 and 12 a suitable space which movably contains the ram 6.

A hopper 13 to guide hoop material is mounted on the movable blade 10 by the same bolts 11 so that the hopper 13 is secured with the ram 6. A fixed blade 14 which is engageable with the movable blade 10 is mounted to the lower surface of the upper base plate 4 by bolts 15. A stock guide 17 of suitable form is secured with the hopper 13. A hopper cover 16 covers the opening between the upper base plate 4 and the hopper 13 as the hopper 13 moves with the movable blade 10. As shown in FIG. 1, the lower end of the hopper 13 terminates in a discharge opening which is defined in part by the front edge of the movable blade 10 and in part by the bottom edge portion of the hopper 13. The width of the discharge opening is wider than the spacing distance between the fixed and movable blades 14 and 10. The bottom edge of the hopper 13 and the bottom surface of the movable blade 10 are coplanar so that the hopper bottom edge can move back and forth over the top of the fixed blade 14 during movement of the ram 6.

Suitable lubricating means (not shown) are provided to lubricate the upper and lower surfaces of the ram 6.

As shown in FIG. 2, guide pins 25 are mounted on the lower surface of the upper base plate 4 adjacent to both side edges of the movable blade 10. As will be described fully hereinafter, the guide pins 25 guide and limit the swirling and rocking cutting movements of the movable blade 10.

Also as shown in FIG. 2, both side edges 27 of the ram 6 project sidewise and elastic packing means 28 seal the clearance between the inner walls of the partition member 18 and the projected edges 27 of the ram 6. As will be described, the ram 6 moves leftwards (return stroke) and rightwards (forward stroke) as shown in FIGS. 1 and 2, and the packing means should be of low friction nature relative to the partition wall 18.

Figure 3A:
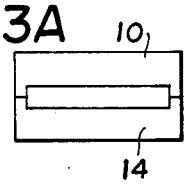
FIGS. 3A–3D are illustrations of the operation sequence of the cutter shown in FIG. 1.

In operation, rotation of the motor 1 is transmitted through the reduction unit 2 and the drive shaft 3 to the eccentric cam 8. The rotation of the eccentric cam 8 is transmitted through the bearing 9 to the ram 6 to cause swirling and rocking movements of the ram 6. Thus, the movable blade 10 and the hopper 13 which are guided by the guide pins 25 move relative to the fixed blade 14 which is mounted on the lower surface of the stationary upper base plate 4 as shown in FIGS. 3A–3D. As shown the movable blade 10 swirls and rocks from the spaced position shown in FIG. 3A, in which the fixed and movable blades 14 and 10 are spaced a predetermined distance from one another, to the position shown in FIG. 3B in which only one end of the movable blade 10 contacts with the fixed blade 14. Thus, hoop material which is fed between the blades 10 and 14 when the movable blade 10 is at the open position shown in FIG. 3A is cut at one edge. Then, as the movable blade 10 moves, the clearance between the blades 10 and 14 decreases to the full closed position shown in FIG. 3C. Thus, the hoop material between the blades 10 and 14 is progressively cut from one end to the other end as the clearance between the blades 10 and 14 diminishes from one end to the other.

Figure 3C:
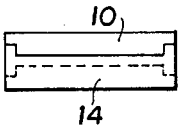
Figure 3B:
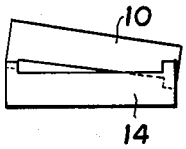

Further, as the hoop material is fed as shown by the arrow 30 in FIG. 1, and as the movable blade 10 moves rightwards in a forward stroke in closing sequence from FIG. 3A to FIG. 3C, the movable blade 10 and the hopper 13 urge the hoop material backwards. Thus, no tension force is applied to the hoop material while the cutting operation is performed. Consequently, undesirable pulling which might cause misalignment of the hoop material relative to the press die is avoided. The backward urging force is absorbed by slight bending of the hoop material.

Figure 3D:
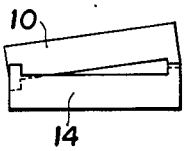

From the position shown in FIG. 3C, the movable blade 10 retreats in a return stroke to the full open position shown in FIG. 3A through the position shown in FIG. 3D. Then the hoop material is fed and the cutting operation is repeated.

Advantages of the cutter according to the present invention are as follows:

As the movable blade 10 rocks relative to the fixed blade 14, sequential cutting by sequential point contact between the blades is performed. Also all through the cutting operation the movable blade 10 and the hopper 13 urge the hoop material opposite to the feed direction of the hoop material. Thus, no undue pulling force is applied to the hoop material. Consequently, the relative positioning between the press and the hoop material cutter can be selected as desired, without concern for any adverse effect from the cutter to the press.

As will be appreciated, the movable blade 10 moves generally back and forth in the space between the upper and lower base plates 4 and 12. The projected edges 27 and packing means 28 effectively prevent debris from entering in the ram moving space.

What is claimed is:

1. A hoop material cutter for cutting hoop material comprising: a frame having a pair of opposed sides and a pair of opposed ends; a fixed blade fixedly mounted near one end of the frame and extending sidewise of the frame; a movable ram movably mounted on the frame to undergo forward and return strokes in the lengthwise direction of the frame and to undergo sidewise rocking movement during the forward and return strokes; a movable blade secured to the ram for movement therewith and coacting with the fixed blade to perform a cutting operation during the forward stroke of the ram, the fixed and movable blades being spaced a predetermined distance from one another when the ram is at the end of its return stroke; means for feeding in a feed direction hoop material to be cut between the fixed and movable blades, the means for feeding comprising a hopper connected to the ram for movement therewith, the hopper having at its lower end a discharge opening defined in part by the movable blade, the discharge opening having a width dimension the same as the minimum width dimension of the hopper and wider than said predetermined distance; drive means mounted on the frame for driving the ram through forward and return strokes and for imparting sidewise rocking movement thereto during the forward and return strokes to effect cutting of the hoop material by the coaction of the fixed and movable blades while urging the hoop material in a direction substantially opposite the feed direction during the cutting operation to avoid exerting a pulling force on the hoop material during cutting thereof; and elastic packing means disposed at both side edges of the ram to seal the clearance between the ram and the frame sides during movement of the ram.

2. A hoop material cutter according to claim 1; wherein the ram has a sector shape having a narrow end and a wide end with the opposite side edges of the wide end being adjacent the frame sides; and wherein the elastic packing means comprises an elastic packing connected to the side edges of the ram wide end.

3. A hoop material cutter according to claim 2; wherein the drive means includes a rotatable eccentric cam rotatably mounted at the ram narrow end, and means for rotationally driving the eccentric cam.

4. A hoop material cutter according to claim 1; wherein the ram has a sector shape having a narrow end and a wide end with the opposite side edges of the wide and being adjacent the frame sides; and wherein the elastic packing means comprises an elastic packing connected to the side edges of the ram wide end.

5. A hoop material cutter according to claim 4; wherein the drive means includes a rotatable eccentric cam rotatably mounted at the ram narrow end, and means for rotationally driving the eccentric cam.

6. A hoop material cutter according to claim 1; wherein the bottom edge portion of the hopper which defines in part the discharge opening and the bottom surface of the movable blade are coplanar to enable the hopper bottom edge to move back and forth over the top of the fixed blade during the forward and return strokes of the ram.

* * * * *